US006182887B1

(12) United States Patent
Ljunström et al.

(10) Patent No.: US 6,182,887 B1
(45) Date of Patent: Feb. 6, 2001

(54) PACKAGE WITH EXTENDED TOP PANEL AND A BLANK THEREFOR

(75) Inventors: Tommy Ljunström, Höör (SE); Sheila Moss, Barrington, IL (US)

(73) Assignee: Tetra Laval Holdings & Finance, SA, Pully (CH)

( * ) Notice: Under 35 U.S.C. 154(b), the term of this patent shall be extended for 0 days.

(21) Appl. No.: 09/293,265

(22) Filed: Apr. 16, 1999

(51) Int. Cl.[7] ..... B65D 5/46; B65D 5/74

(52) U.S. Cl. ..... 229/112; 206/806; 229/117.23; 229/117.24; 229/117.3; 229/125.15; 229/125.42; 229/137; 229/138

(58) Field of Search ..... 229/112, 117.23, 229/117.24, 117.3, 125.15, 125.42, 137, 138, 164; 206/806

(56) References Cited

U.S. PATENT DOCUMENTS 1,597,251 * 8/1926 Shill ..... 229/117.24
2,138,718 * 11/1938 Wheeler ..... 229/112
2,846,063 * 8/1958 Fahrenbach ..... 229/117.23
2,979,192 * 4/1961 Blonder ..... 206/806
3,773,249 * 11/1973 Hidding ..... 229/117.24
4,266,671 * 5/1981 Roccaforte ..... 206/806
4,572,422 * 2/1986 Heuberger et al. ..... 229/117.3
5,176,313 * 1/1993 Curry et al. ..... 229/125.15
5,772,109 * 6/1998 Phipps ..... 229/117.23

FOREIGN PATENT DOCUMENTS 09262969 4/1999 (JP) .
1191792 4/1999 (JP) .

* cited by examiner

*Primary Examiner*—Gary E. Elkins
(74) *Attorney, Agent, or Firm*—Welsh & Katz, Ltd.

(57) ABSTRACT

A package with an extended top panel has a front wall, a rear wall and a pair of parallel side walls. The package includes at least one top panel that seals to the package at a sealing region. A plane through the sealing region is spaced from a central vertical plane through the package. The extended top panel can extend to the rear wall at the sealing region. A second lesser top panel can extend from the rear wall and can seal with the extended front panel at an off-center top fin. A closure is accommodated on the top panel that has a cap having a diameter greater than the diameter of an aperture disposed through the extended top panel. A blank for the package is also disclosed herein. The package can include a handle attached to its top fin for carrying and displaying the package.

18 Claims, 13 Drawing Sheets

PACKAGE WITH EXTENDED TOP PANEL AND A BLANK THEREFOR

FIELD OF THE INVENTION

The present invention relates to a package having a closure disposed thereon. More specifically, the present invention relates to a package with an extended top panel for pronounced positioning of a closure on the top panel, and a blank therefor.

BACKGROUND OF THE INVENTION

A preferred package for milk and juice is the gable-top package. The gable-top package is usually composed of a paperboard material coated on its exterior and interior surfaces with a thermoplastic material such as polyethylene. The package is formed from a blank that has a plurality of crease lines for proper folding of the blank into the desired package shape.

The unconstructed form, or blank has a plurality of side panels (usually four) and corresponding top panels and bottom panels. The four side panels define the front, rear and side walls of the package while the top panels form the well-known gable-top. Known gable-top packages have two equal and opposite top panels meeting at the top fin of the gable-top. The other two top panels are folded under these two opposing top panels. The aesthetically pleasing gable-top design has a functional aspect that leads to its structure and design. That function is to provide an integrated spout for accessing the product contained with the gable-top package. The integrated closure is formed by unsealing one of the folded-under top panels and pulling it outward to form the integrated spout.

In order to allow a consumer to unseal the top panel, it is sometimes necessary to provide an abhesive, or to lessen the top seal in some other manner. This has created problems for products that require tight seals to prevent oxygen transmission that could otherwise degrade the product. Also, after initially opening the package, the resealing of the package is not as tight as desired by some consumers.

The packaging industry responded to this problem by providing plastic closures (also referred to as fitments) that allow for a tight reseal after initial access of the product. The closure is attached to the carton either through an aperture in a top panel prior to filling, or on the exterior of the carton over an aperture prior to filling or after top sealing. Various attachment methods have been used to apply the closure to the carton, such as ultrasonic sealing, hot melt, induction sealing and the like. Thus, the only modification to the traditional gable-top package has been the attachment of the closure to one of the opposing top panels.

The gable-top package with the closure on one of the opposing top panels has come to dominate the packaging of juice, and is a favorite for milk and milk related products such as coffee creamers. The closure can be a screw-cap closure or a flip-cap closure, both of which are resealable, and can be attached through the aforementioned application methods. Pourability of the product from the package through the closure is acceptable; however, product does not pour as well as from the older designs that include an integrated spout, because of the placement of the closure in the center of the top panel. In addition, the closure is usually a predetermined size that corresponds to the surface area of the top panel, which restricts or limits alterations to the closure and new closure designs.

These restraints on the closure are created, in part, by the development of the closure for the established gable-top package. These closures have been adapted to the structure and design of the gable-top package. This included the fabrication process of the gable-top package from a carton on a form, fill and seal packaging machine, such as a TETRA REX® packaging machine available from Tetra Pak Incorporated of Chicago, Ill.

Accordingly, there is a need for a package that can accommodate a variety of closure types and designs. Desirably, such a package will accommodate closures configured for enhanced product pourability. Most desirably, such a package can be used with, i.e., constructed and sealed on, currently known and operated packaging machines.

SUMMARY OF THE INVENTION

A package includes an extended top panel, a closure, a front wall, a rear wall and parallel side walls. The extended top panel can be formed with an aperture therethrough for accommodating a closure. The front wall engages the extended top panel at a first edge and has a length. The rear wall is opposite the front wall and has a length. In a preferred embodiment, the rear wall length is greater than the length of the front wall. The first and second parallel side walls engage the front wall at front edges and the rear wall at rear edges. The extended top panel is sealed to the rear wall or a lesser top panel at a sealing region. A vertical plane through the sealing region is spaced from (non-coplanar with) a vertical plane through the center of the package.

For purposes of the present disclosure, three "forms" of the present package will be referred to herein. A first form, in which the package is fully or partially constructed, with the side seal in place and with the top and bottom panels sealed is referred to as a "package". This is the gable-top package commonly known by consumers and recognized from retailer's and marketer's shelves and displays. A "carton" is that form of the package that has a tubular form. That is, the side seal has been made, but the top and bottom panels are yet unconstructed (unfolded and/or unsealed). Thus, this form has a tubular shape, and is commonly known by paper or stock suppliers and packagers. A "blank" is that form in which the stock material is laid flat, with no seals yet made. That is, the material has been cut, and the creases made in the stock material, but the material is unfolded and unsealed.

The extended top panel can extend from the rear wall to the front wall and have an angle less than ninety degrees to the rear wall. The package can include a second top panel that meets the extended top panel at a top fin of the package. The top fin is coextensive with the sealing region. Preferably, the second top panel has a surface area less than a surface area of the extended top panel. The first and second side walls can have slanted top edges parallel to one another. A preferred angle of the extended top panel to the rear wall is about forty-five degrees to about eighty degrees. In such an arrangement, the top fin of the package is off-center. The present package can use a closure having a cap with a diameter greater than a diameter of the aperture formed in the package to receive the pour spout.

The package can also include a handle attached to the package, preferably at the top fin. A multiple of packages can be attached to a single handle to facilitate carrying the packages. The handle can be formed with an unattached section and an attached section with the unattached section foldable over the attached section to facilitate pouring the contents from the container.

Another aspect of the present invention is a blank for a package with an extended top panel. The blank includes an extended top panel, a rear wall panel, a first side wall panel, a front wall panel and a second side wall panel. In a preferred embodiment, the rear wall panel has a length greater than the length of the front wall panel. A plurality of vertical score lines partition each of the panels from adjacent panels. The extended top panel is adjacent the front wall panel and is partitioned from the front wall panel by a first horizontal score line. The extended top panel can have an aperture therethrough for receiving an optional pour spout.

The blank can include a plurality of slanted top panels. The rear wall of the blank can be formed without a top panel. The first side wall panel of the blank can be partitioned from a corresponding slanted top panel by a first slanted score line, and the second side wall panel partitioned from a corresponding slanted top panel by a second slanted score line. The rear wall of the blank has a corresponding top panel partitioned therefrom by a horizontal score line. The corresponding top panel of the rear wall panel has a surface area that is less than a surface area of the extended top panel. The blank can include a plurality of triangular top panels.

In one embodiment, the blank includes a central top fin panel that is partitioned from the extended top panel by a top horizontal score line. The central top fin panel can be juxtaposed on each side by first and second horizontal top fin panels. The first and second horizontal top fin panels can each have slanted top fin panels adjacent thereto.

Another aspect of the present invention is a package including a single top panel, a front wall, a rear wall, first and second parallel side walls and a closure. The single top panel can include an aperture therethrough for accommodating an optional closure that is disposed about the aperture. The front wall engages the single top panel at a first edge and has a length. The rear wall is opposite the front wall and engages the single top panel at a second edge. The rear wall has a length that is greater than the length of the front wall. The first and second parallel side walls engage the front wall at front edges and the rear wall at rear edges. The first and second parallel side walls each engage the single top panel at slanted edges.

This aspect of the present invention can include a top fin disposed on the rear wall. The package is configured to receive a closure having a cap with a diameter greater than a diameter of the aperture formed in the package for receiving the pour spout.

Other features and advantages of the present invention will be apparent from the following detailed description, the accompanying drawings and the appended claims.

DETAILED DESCRIPTION OF THE PREFERRED EMBODIMENTS

Figure 1:
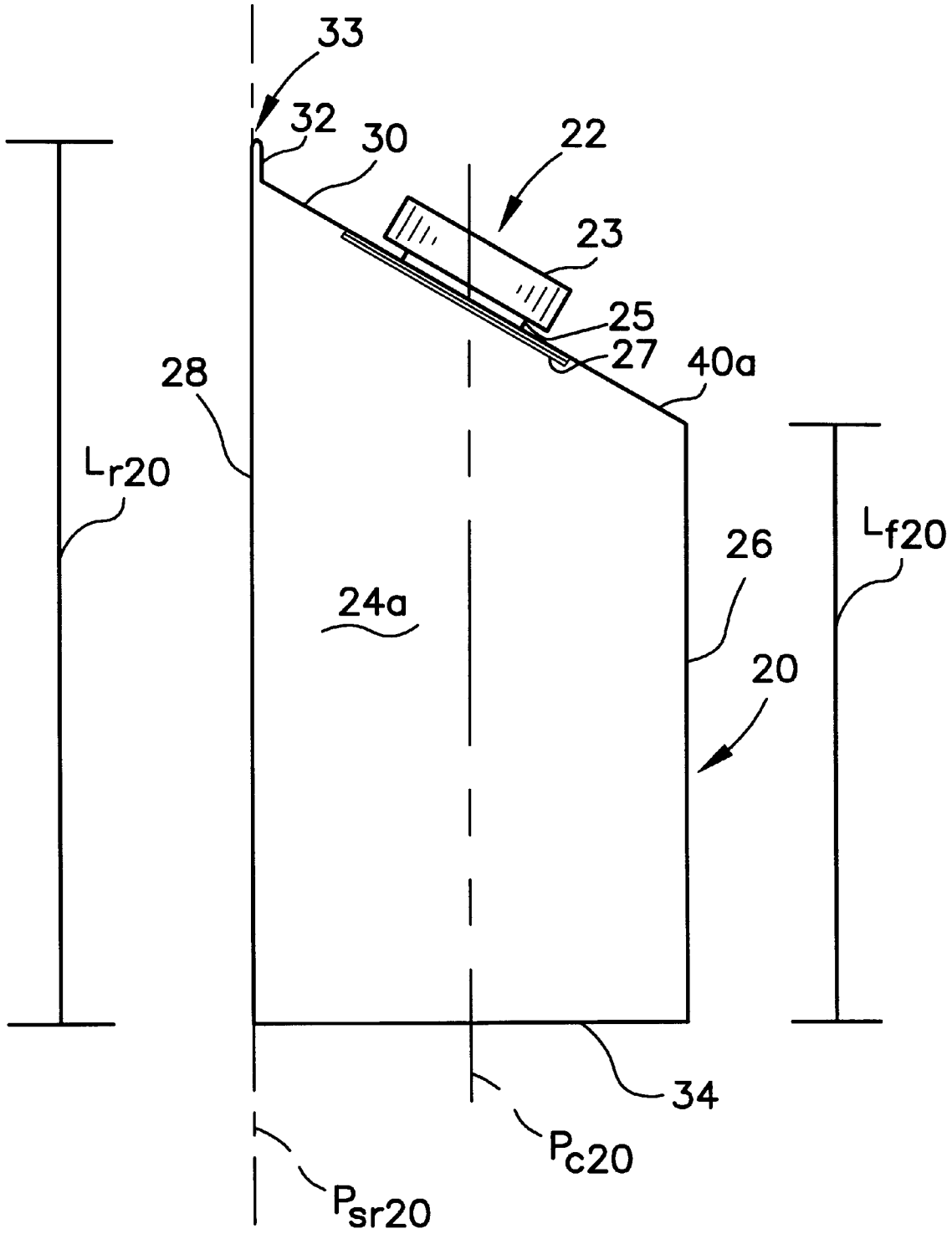
FIG. 1 is a side view of one embodiment of a package with an extended top panel embodying the principles of the present invention, the illustrated package shown with an exemplary closure positioned thereon.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Figure 2:
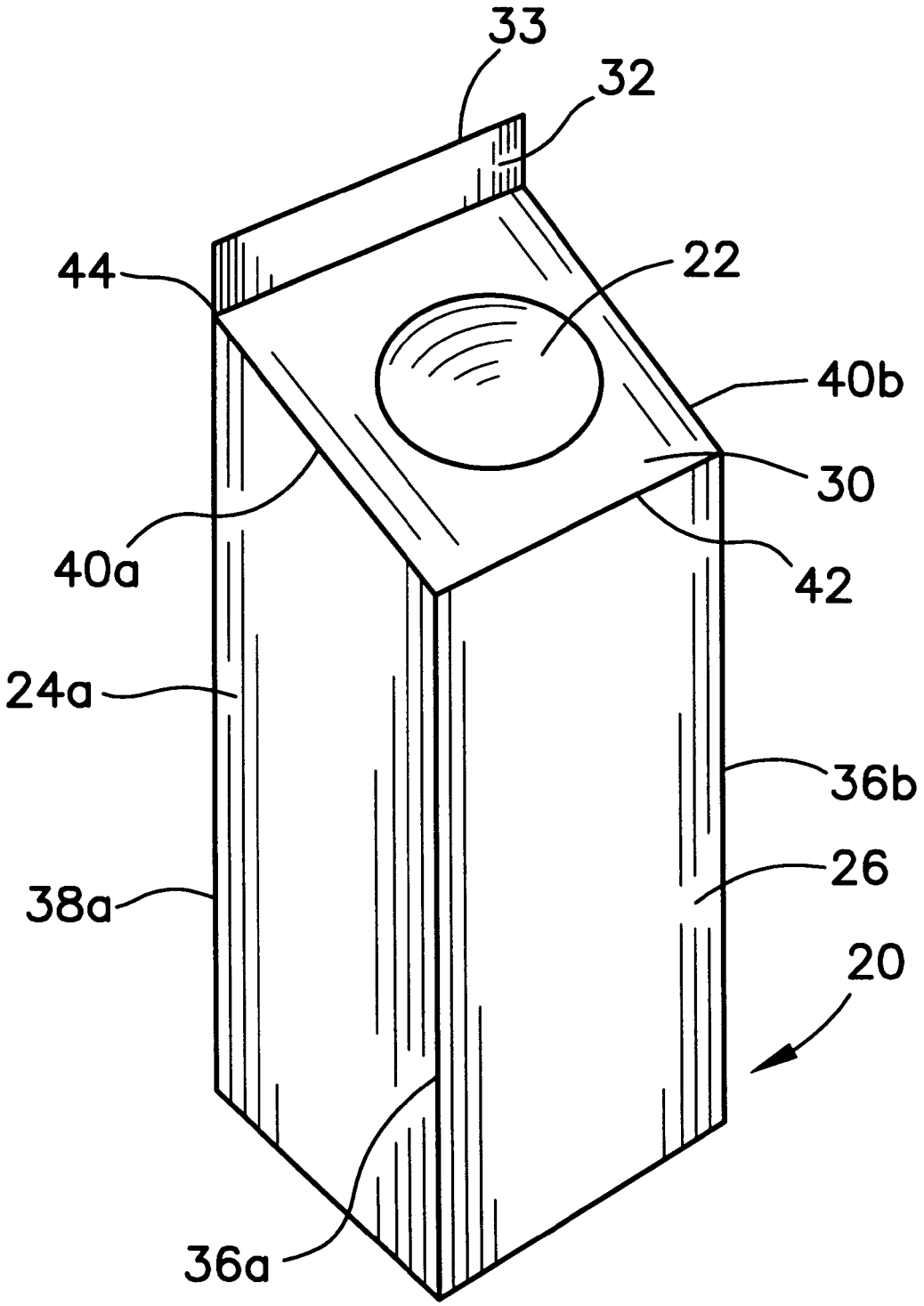
FIG. 2 is a perspective of the package of FIG. 1.
Figure 3:
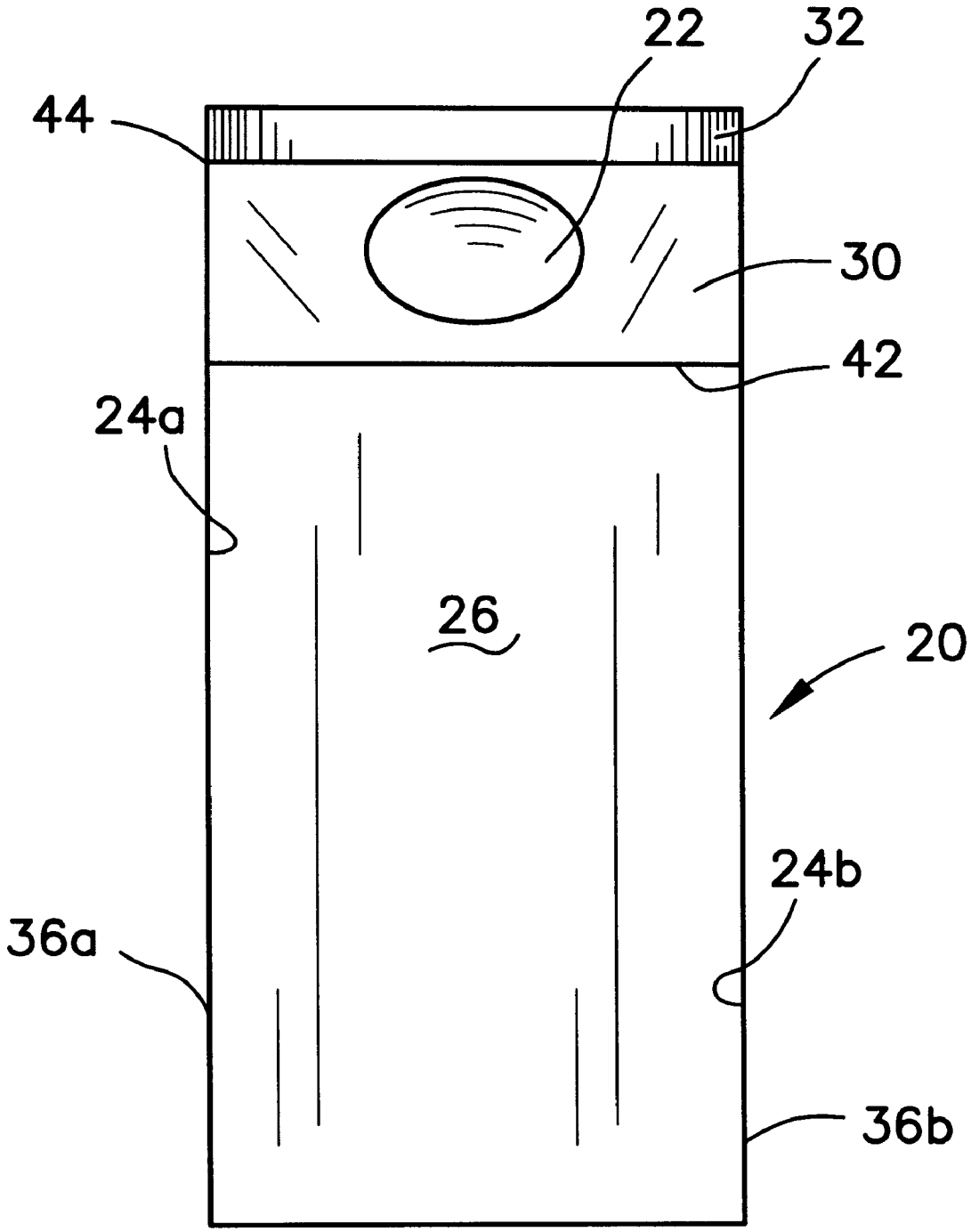
FIG. 3 is a front view of the package of FIG. 1.

Referring now to the figures and in particular to FIGS. 1–3, there is shown a preferred embodiment of a package 20 embodying the principles of the present invention. An optional closure 22 is disposed on the package 20. The package 20 has first and second side walls 24*a,b,* a front wall 26, a rear wall 28, an extended top panel 30 and a top fin 32. The bottom of the package 20 is generally designated 34. Edge 36*a* defines the intersection of the front wall 26 and the side wall 24*a,* and edge 36*b* defines the intersection of the front wall 26 and the side wall 24*b*. Edge 38*a* defines the intersection of the rear wall 28 and the side wall 24*a,* and edge 38*b* (not shown), defines the intersection of the rear wall 28 and side wall 24*b*. A slanted edge 40*a* defines the intersection of the top panel 30 and the side wall 24*a,* and a slanted edge 40*b* defines the intersection of the top panel 30 and the side wall 24*b*. A front edge 42 defines the intersection of the top panel 30 and the front wall 26, and a rear edge 44 defines the intersection of the top panel 30 and the rear wall 28.

As set forth above, three "forms" of the present package will be referred to herein. A first form, in which the package is fully or partially constructed, with the side seal in place and with the top and bottom panels sealed is referred to as a "package". This is the gable-top package commonly known by consumers and recognized from retailer's and marketer's shelves and displays. A "carton" is that form of the package that has a tubular form. That is, the side seal has been made, but the top and bottom panels are yet unconstructed (unfolded and/or unsealed). Thus, this form has a tubular shape, and is commonly known by paper or stock suppliers and packagers. A "blank" is that form in which the stock material is laid flat, with no seals yet made. That is, the material has been cut, and the creases made in the stock material, but the material is unfolded and unsealed.

As can be seen form FIG. 1, the extended top panel 30 and rear wall 28 are sealed to one another at a sealing region 33, which in the present embodiment is coextensive with the fin 32. Unlike known gable-top packages, the sealing region 33 or fin 32 is positioned asymmetrically, that is spaced from a vertical plane $P_{c20}$ through the center of the package 20. This vertically asymmetrical configuration, and asymmetrical plane $P_{sr20}$ though the sealing region, is a novel feature not known in current package arrangement, in which a vertical plane through the center of the package also extends through the fin and defines mirror image, symmetrical package "halves" or portions.

Front wall 26 has a length $L_{f20}$ and rear wall 28 has a length $L_{r20}$. The length $L_{f20}$ is less than the length $L_{r20}$. This difference in the lengths, i.e., $L_{f20}$ less $L_{f20}$, creates the extended top panel 30. Thus, the front edge 42 is lower than the rear edge 44 when the package 20 is in an upright position as shown. The top panel 30 is at a predetermined angle $\alpha_{20}$ to the rear wall 28. The angle $\alpha_{20}$ can be about 10 degrees to about 90 degrees, and preferably, about 30 degrees to about 80 degrees. Most preferably, the angle $\alpha_{20}$ is about 45 degrees to about 75 degrees. A most preferred angle $\alpha_{20}$ is 65 degrees.

Referring now to FIG. 1, the closure 22 typically includes a cap 23, a pour spout 25 and a flange 27. The package 20 is configured to accommodate a larger than typical spout 25 and/or cap 23. Unlike known packages, the closure 22 of the present package 20 can be larger than known package closure because the present package 20 is configured to accommodate the closure 22, rather than the accepted practice of the closure being configured for the package. The closure 22 can cover a large portion of the area of the top panel 30, and can cover at least half of the surface area of the top panel 30, the surface area being defined as the area within the edges 40*a,* 40*b,* 42 and 44.

The closure 22 can be attached or mounted to the package 20 in any of a variety traditional, known application methods such as ultrasonic sealing, induction sealing, hot melt adhesive, and the like. However, if the cap 23 has a diameter d that is greater than the diameter of the aperture 48 (FIG. 4), then the cap 23 may be attached in a separate operation from the attachment of the entirety of the closure 22. Alternately, the closure 22 may be applied in a post processing application such as disclosed in co-pending U.S. patent application Ser. No. 09/238,768 which was filed on Jan. 28, 1999, entitled Post-Processing Fitment Applicator, which relevant parts are hereby incorporated by reference. Such a post processing application allows for a closure 22 of any size and shape to be applied to the package 20. Additionally, the closure 22 may have a membrane or like seal (not shown) covering the spout 25 to prevent contamination of the product prior to attachment of the cap 23.

The extended top panel 30 also provides a greater surface area for printing to permit enhanced marketing for the product. Marketing of the product will be further described below.

Figure 4:
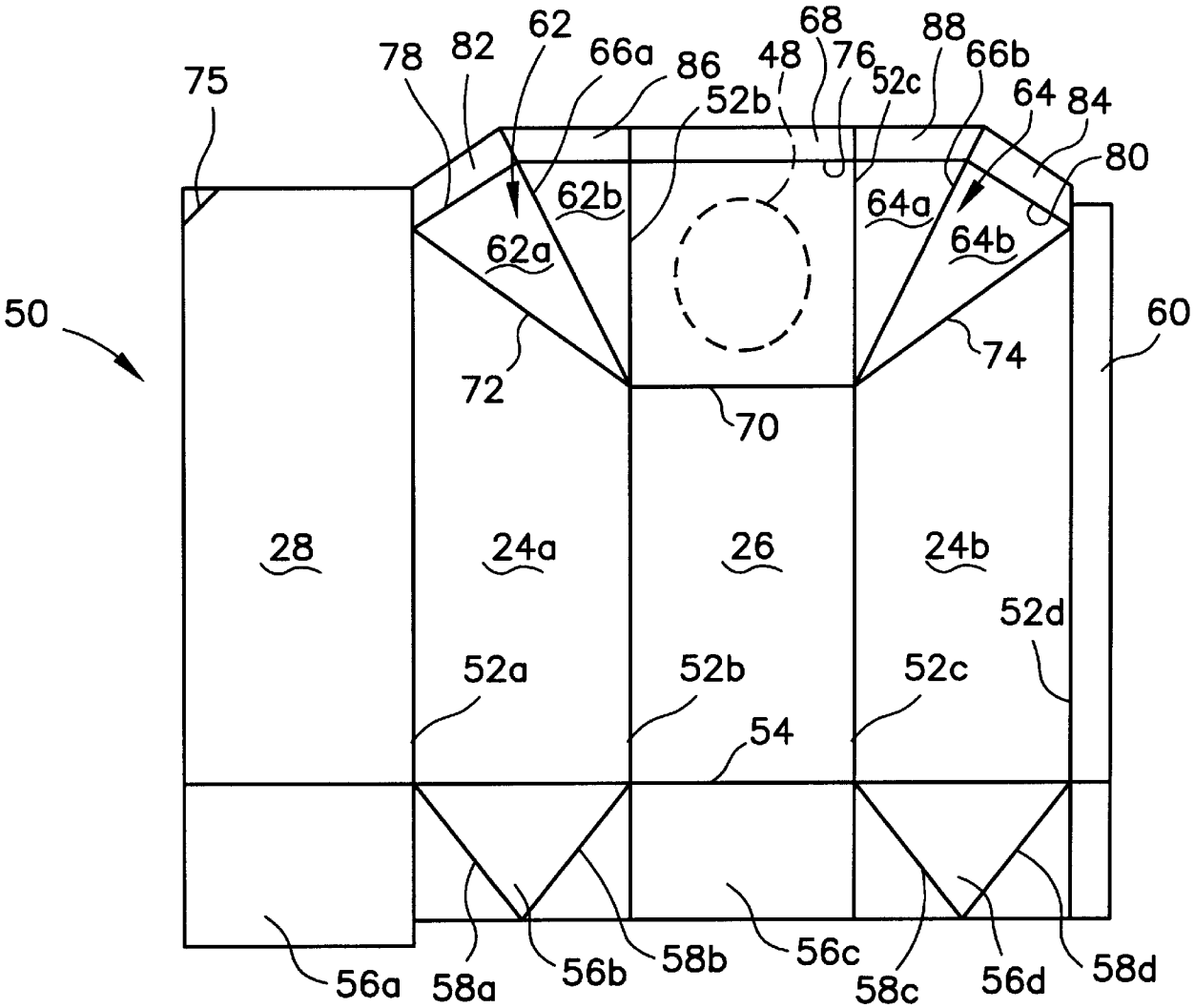
FIG. 4 is a plan view of one embodiment of a blank for the package of FIG. 1.

A blank 50 for the package 20 is shown in FIG. 4. The blank 50 has a plurality of panels that correspond to the front wall 26, the rear wall 28 and the side walls 24*a,b.* The panels are partitioned from one another by a plurality of vertical score lines 52*a–d.* A plurality of corresponding bottom panels 56*a–d* are partitioned from the corresponding panels 24*a,b,* 26 and 28 by a lower horizontal score line 54. A plurality of lower diagonal score lines 58*a–d* further define bottom panels 56*b* and 56*d* for folding the carton bottom 34. A sealing panel 60 is longitudinally sealed to the rear wall 28.

The top panel 30 is distinguished by the optional aperture 48, which as previously mentioned, can occupy a significant portion of the surface area of the top panel 30. The aperture 48 can be formed in the blank 50 if the package 20 is to be fitted with the optional closure 22. The aperture 48 can be formed as an opening in the blank 50 or it can be formed by forming a weakened region (a score line or perforations) to define the outline of the aperture. Alternately, if the package 20 is to be fitted with a post-process closure, the blank 50 can be formed with no aperture therein.

The top panel 30 is partitioned from the front wall 26 by an upper horizontal score line 70. A side top panel 62 may be divided by a slanted score line 66*a* to form top panels 62*a* and 62*b.* Likewise, side top panel 64 may be divided by a slanted score line 66*b* to form top panels 64*a* and 64*b.* It should be noted that the rear wall panel 28 does not have a corresponding top panel; however, it is formed with a slanted score line 75 for folding purposes.

The top fin 32 of the package 20 is formed by a plurality of panels 68, 82, 84, 86 and 88. Fin panel 68 is partitioned from the top panel 30 by a top horizontal score line 76 that partitions fin panels 86 and 88 from slanted top panels 62*b* and 64*a* respectively. Slanted score line 78 partitions fin panel 82 from slanted top panel 62*a,* and slanted score line 80 partitions fin panel 82 from slanted top panel 64*b.*

In a typical packaging machine (not shown), the blank 50, with the sealing panel 60 sealed to the rear wall panel 28 (as a carton), is supplied from a magazine and erected on a mandrel. The bottom 34 of the carton 20 is formed on the mandrel. The partially-formed package 20 is then discharged from the mandrel to a conveyor. The conveyor transports the partially-formed package to various stations on the packaging machine. A first station can be a closure application station, followed by a sterilization station. Packages can then be conveyed to a filling station where the product is dispensed into the package 20 through the open top. The next and final station may be a top sealing station. The top sealing station may require modification from the traditional top sealing station because the top fin 32 is not disposed symmetrically about the central vertical plane $P_{c20}$ of the package; rather the coextensive sealing region 33 and fin 32 are asymmetrically positioned relative to the package 20, and in the same vertical plane $P_{sr20}$ as the rear wall 28.

The various stations in any given packaging machine can be varied, and the above discussion is intended to provide an exemplary operation only. As such, the above-discussed packaging operation is not intended to limit the present invention in any manner, but is provided for an understanding of the operation of one known packaging machine system.

Figure 5:
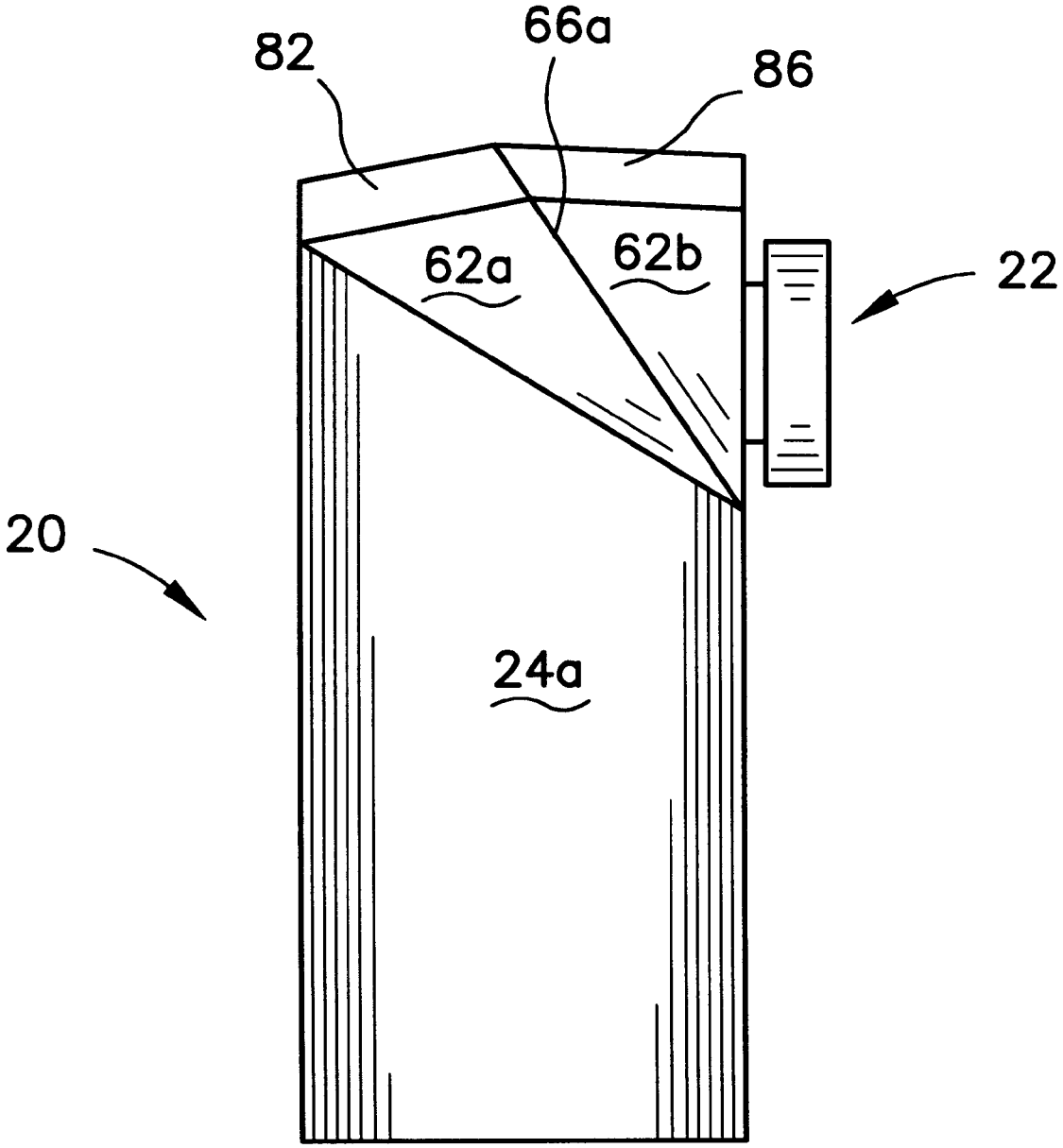
FIG. 5 is a side view of one portion of an exemplary folding operation for fabricating the package of FIG. 1 from the blank of FIG. 4.

FIG. 5 illustrates the folding operation that is carried out on the partially-formed package 20 after filling and prior to top sealing. The slanted top panels 62*a* and 62*b* are pushed inward at score line 66*a* to fold panel 62*b* over panel 62*a*. A similar operation is carried out on panels 64*a,b.* Top panel 30 is then folded over the now folded slanted top panels 62*a,b* and 64*a,b.* Fin panels 68, 82, 84, 86 and 88 are then sealed to one another in the top sealing operation to form the package 20 of FIG. 1.

Figure 6:
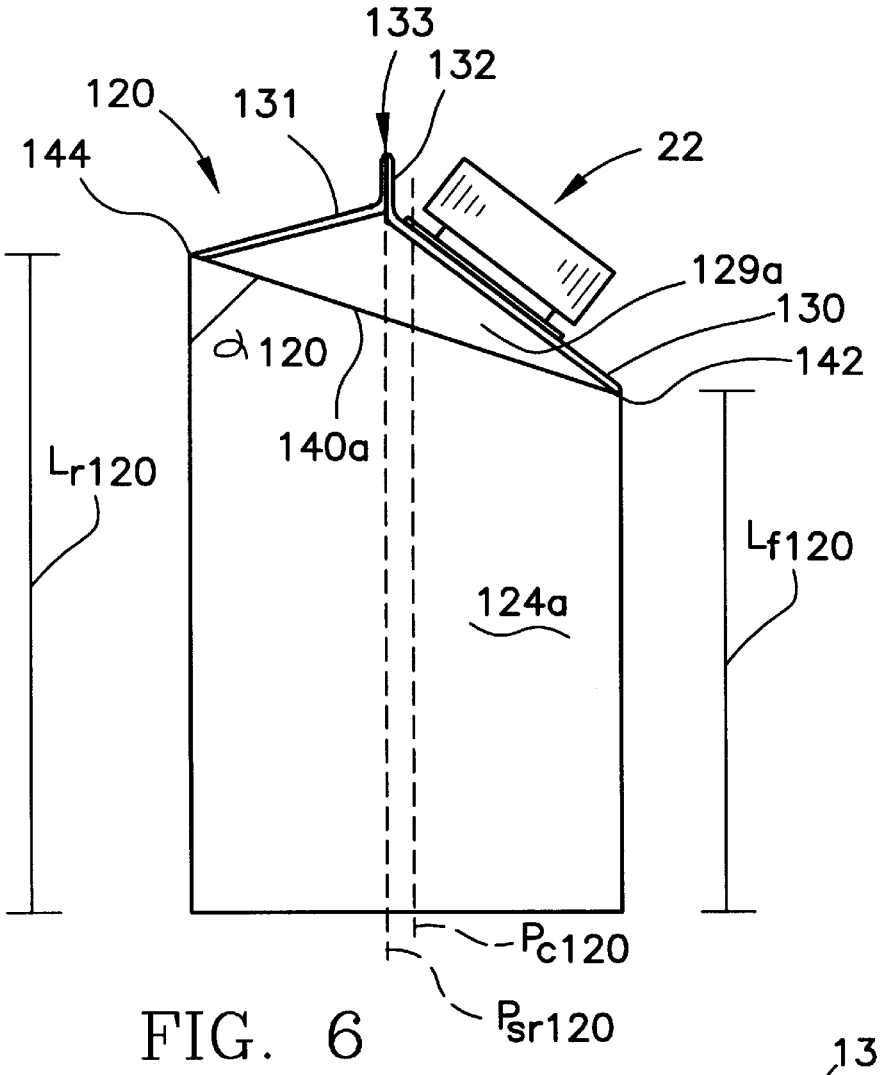
FIG. 6 is a side view of a preferred alternate embodiment of a package embodying the principles of the present invention, the alternate embodiment being illustrated with a closure positioned thereon.
Figure 6A:
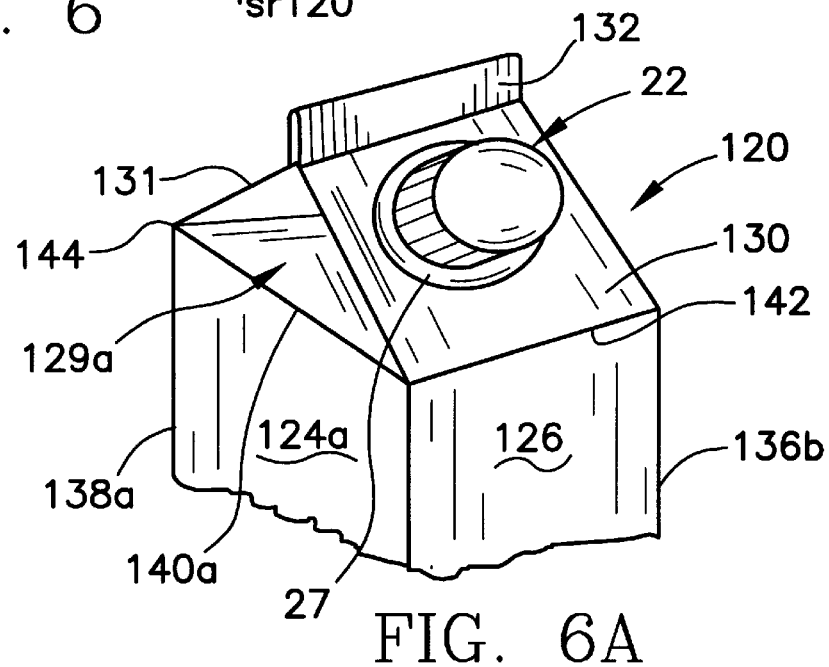
FIG. 6A is a perspective view of the package of FIG. 6.

A most preferred embodiment of the package 120 embodying the principles of the present invention is illustrated in FIGS. 6 and 6A. The package 120 can include an optional closure 22 that is similar to the closure illustrated with the embodiment of the package 20 of FIGS. 1–3. The package 120 has first and second side walls 124*a,b* (124*b* not shown), a front wall 126, a rear wall 128 (not shown), an extended top panel 130, a second lesser top panel 131 and a top fin 132. An edge 136*a* defines the intersection of the front wall 126 and the side wall 124*a,* and an edge 136*b* defines the intersection of the front wall 126 and the side wall 124*b*. Likewise, edge 138*a* defines the intersection of the rear wall 128 and the side wall 124*a,* and edge 138*b* defines the intersection of the rear wall 128 and side wall 124*b*.

Figure 8:
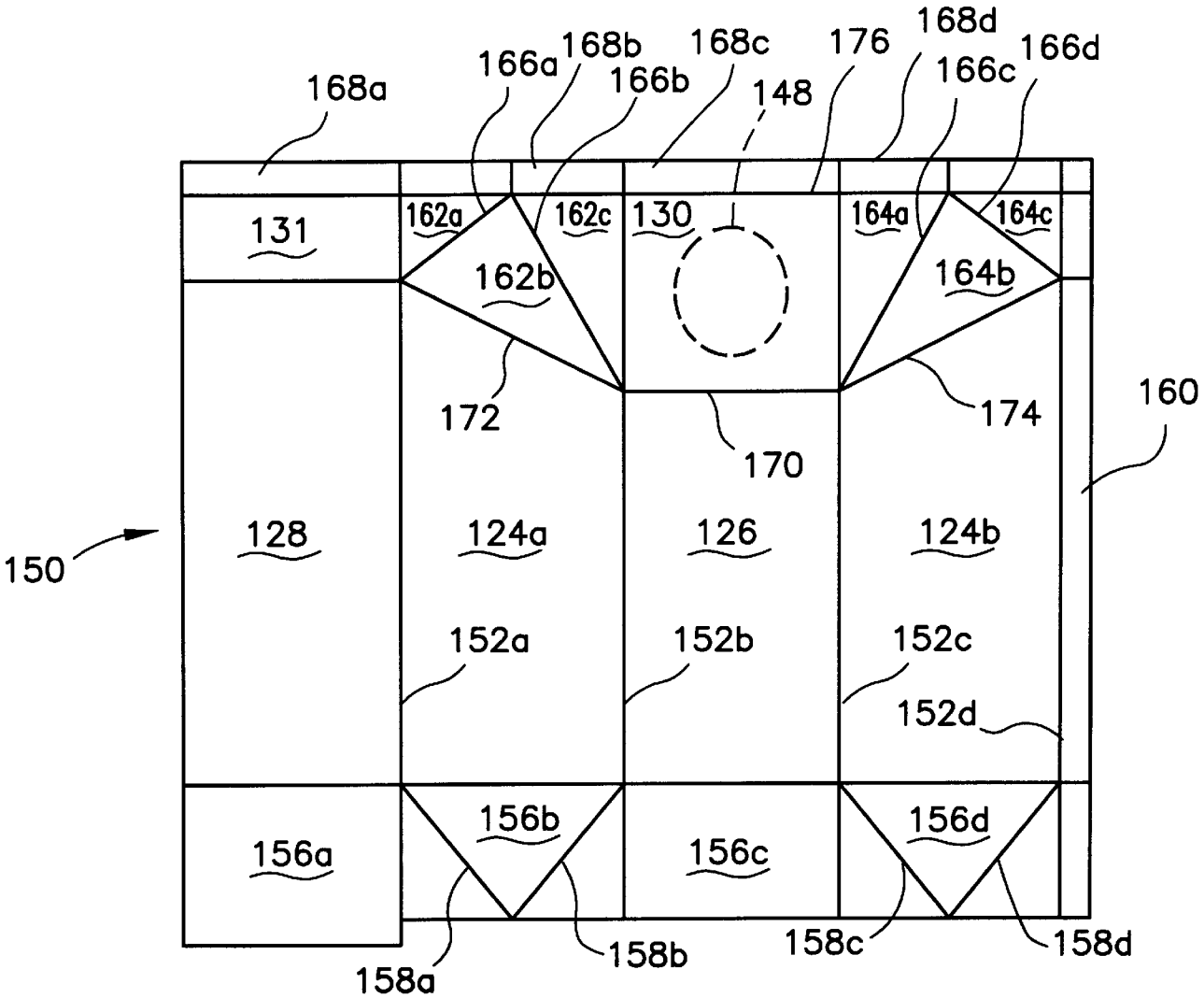
FIG. 8 is a plan view of one embodiment of a blank for the package of FIG. 6.

In this configuration, unlike the package 20 of FIGS. 1–3, an inner gable portion 129*a,b* is formed on each side of the package above the side walls 124*a,b* and below and between the extended and lesser top panels 130, 131. To this end, a slanted edge 140*a* defines the intersection of a triangular inner top panel 162*b* (FIG. 8) and the side wall 124*a,* and a slanted edge 140*b* defines the intersection of the opposing triangular inner top panel 164*b* (FIG. 8) and the side wall 124*b*. Edge 140*a* corresponds to crease line 172 (FIG. 8) and edge 140*b* corresponds to crease line 174 (FIG. 8). This relationship is presented in more detail below in the portion of the present disclosure that is directed to the package blank. A front edge 142 defines the intersection of the top panel 130 and the front wall 126, and a rear edge 144 defines the intersection of the second lesser top panel 131 and the rear wall 128.

The extended top panel 130 and the second lesser top panel 131 meet at the sealing region 133, which in this embodiment is coextensive with a top fin 132. As will be seen from FIG. 6, the coextensive sealing region 133 and top fin 132, are generally off-center from an the central plane $P_{c120}$ through the package 120. Thus, the vertical plane $P_{sr120}$ through the fin 132 and sealing region 133 defines asymmetrical package portions on each side of the plane. This results in the extended top panel 130 having a greater surface area than the second lesser top panel 131.

The front wall 126 has a length $L_{f120}$ and the rear wall 128 has a length $L_{r120}$. As will be apparent from FIG. 6, the length $L_{f120}$ is less than the length $L_{r120}$, which difference in lengths creates the extended top panel 130. Thus, the front edge 142 is lower than the rear edge 144 when the package 120 is in an upright position as shown. The slanted edges 140*a* and 140*b* are at an angle $\alpha_{120}$ to the rear wall 128. The angle $\alpha_{120}$ can be about 10 degrees to about 90 degrees, and is preferably about 30 degrees to about 80 degrees. A more preferred angle $\alpha_{120}$ is about 45 degrees to about 85 degrees, and a most preferred angle $\alpha_{120}$ is about 75 degrees.

The extended top panel 130 also provides a greater surface area for printing, which allows for enhanced marketing of the product. Marketing of the product will be further described below. The second lesser top panel 131 also provides a surface area for printing.

A blank 150 for the package 120 is shown in FIG. 8. The blank 150 has a plurality of panels that correspond to the front wall 126, the rear wall 128 and the side walls 124*a,b*. The panels are partitioned from one another by a plurality of vertical score lines 152*a–d*. A plurality of corresponding bottom panels 156*a–d* are partitioned from the corresponding panels 124*a,b,* 126 and 128 by a lower horizontal score line 154. A plurality of lower diagonal score lines 158*a–d* further define bottom panels 156*b* and 156*d* for folding purposes. A sealing panel 160 is longitudinally sealed to the rear wall 128.

The extended top panel 130 is distinguished by the optional aperture 148, which as previously mentioned, can occupy a significant portion of the surface area of the extended top panel 130. The aperture 148 can be formed in the blank 150, if it is contemplated to use a closure with the intended package. As set forth above, if no closure is intended, or if a post-process closure application is contemplated, the aperture may not be formed in the blank 150.

The top panel 130 is partitioned from the front wall 126 by an upper horizontal score line 170. A side top panel 162 is partitioned by slanted score lines 166*a* and 166*b* to form triangular top panels 162*a,* 162*b* and 162*c*. Likewise, side top panel 164 is partitioned by slanted score lines 166*c* and 166*d* to form triangular top panels 164*a,* 164*b* and 164*c*. The rear wall panel 128, unlike rear wall panel 28 of FIG. 4, has a corresponding top panel 131 which is partitioned therefrom by an upper horizontal score line 175.

The top fin 132 of the package 120 is formed by a plurality of fin panels 168*a–d*. The fin panels 168*a–d* are partitioned from their corresponding top panels by a top horizontal score line 176.

Figure 7:
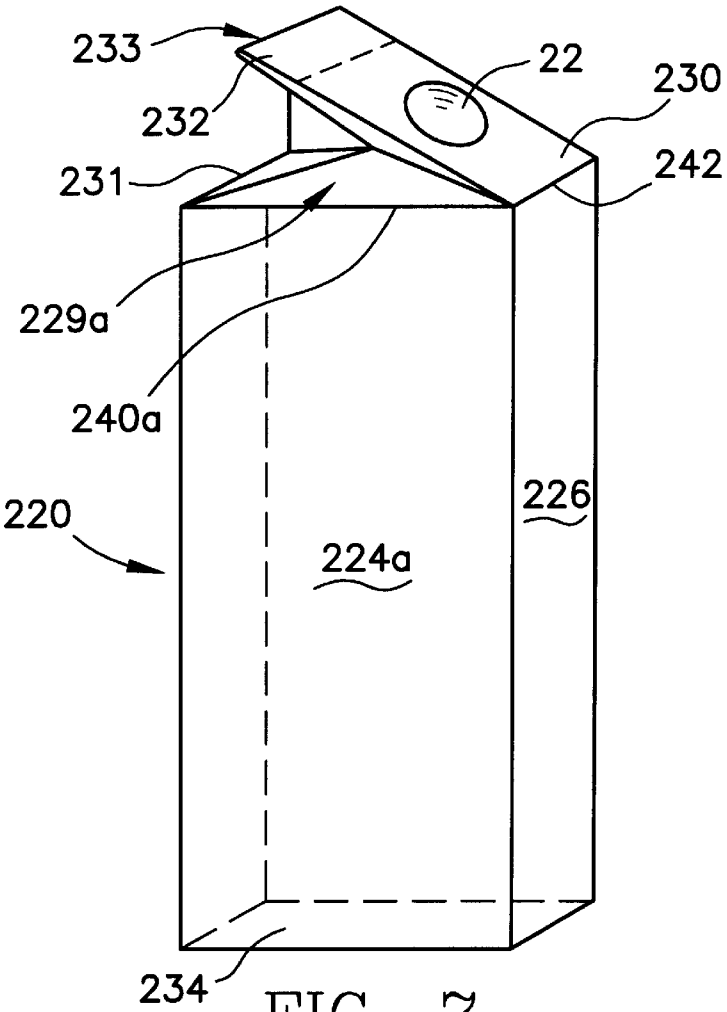
FIG. 7 is a perspective view of yet another alternate embodiment of a package of the present invention.
Figure 7A:
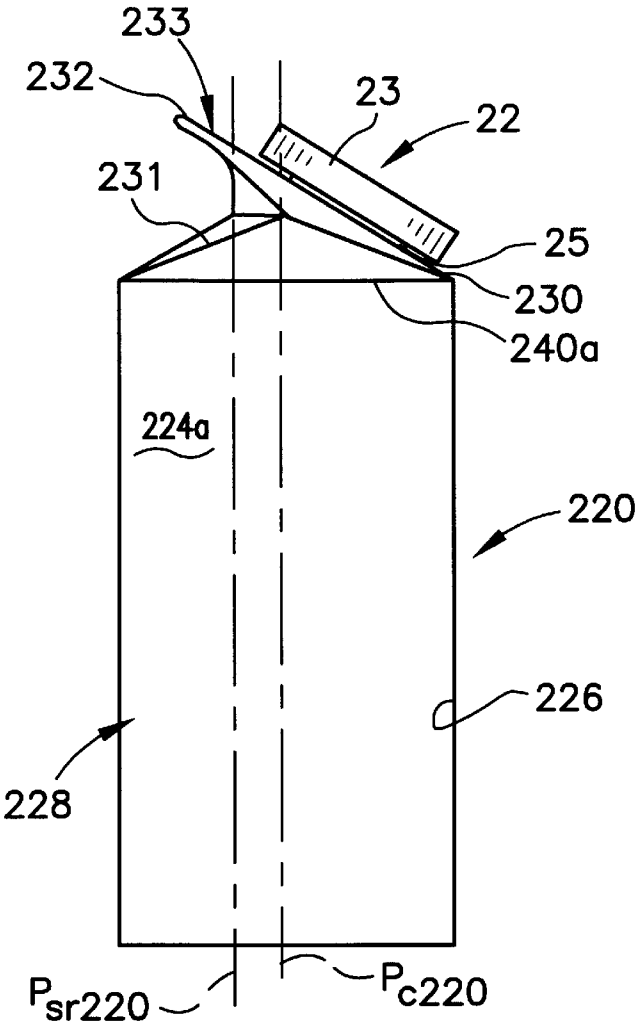
FIG. 7A is side view of the package of FIG. 7.

Still another embodiment of the package 220 is illustrated in FIGS. 7 and 7A. In this contemplated embodiment, the top panel 230 is extended, however, the rear wall 228 and the front wall 226 are of the same length. Like the first and second embodiments 20, 120, the second lesser top panel 231 of this embodiment 220, engages the extended top panel 230 off center from the central plane $P_{c220}$ of the package 220. The edges 240*a* and 240*b* (not shown) are not slanted, but rather are generally parallel to the package bottom 234. The extended top panel 230 of the package 220 is configured to accommodate the optional enlarged closure 22 thereon.

Figure 7B:
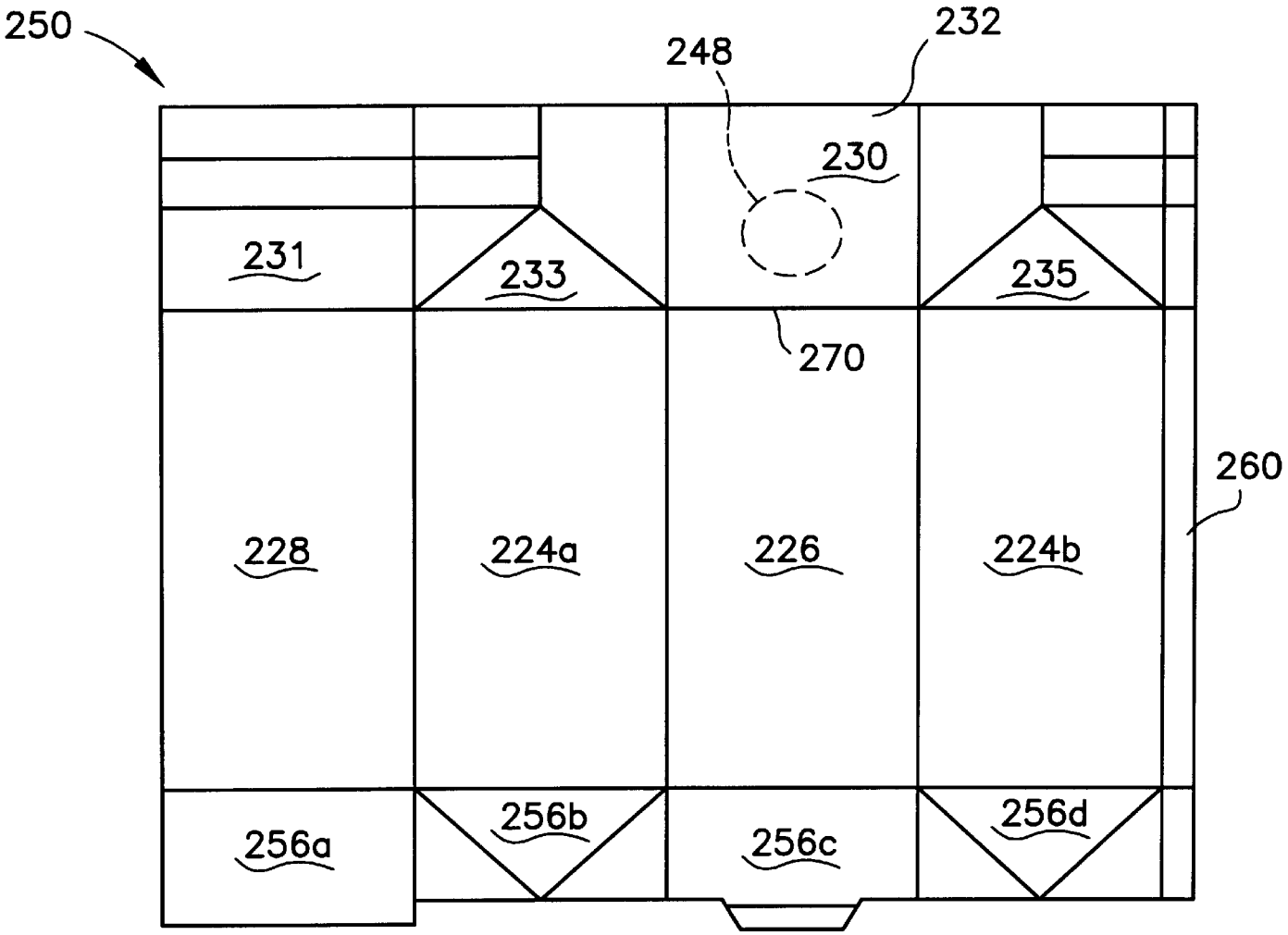
FIG. 7B is a plan view of one embodiment of a blank for the package of FIG. 7.

In this embodiment of the package 220, the fin 232, while off center from the central vertical plane $P_{c220}$ of the package, is not vertically oriented. Rather, as seen in FIG. 7, the fin 232 is angled or slanted in about the same plane as the extended top panel. This configuration defines an asymmetrical package relative to a vertical plane $P_{sr220}$ through the fin 232 at the sealing region 233. That is, a plane $P_{sr220}$ through the sealing region 233 and fin 232 is spaced from a vertical, centrally disposed plane $P_{c220}$ through the package 220. In addition, similar to the embodiment 120 illustrated ion FIGS. 6 and 6A, an inner gable portion 229*a,b* is formed on each side of the package 220, above the side walls 224*a,b* and below and between the extended and lesser top panels 230, 231. One exemplary blank 250 for this embodiment of the package 220 is illustrated in FIG. 7B. The blank 250 is configured in much the same manner as the blank 150 of the package 120 of FIGS. 6 and 6A. An aperture 248 is shown in the blank 250 in phantom lines to illustrate the optional nature of this element.

Figure 9:
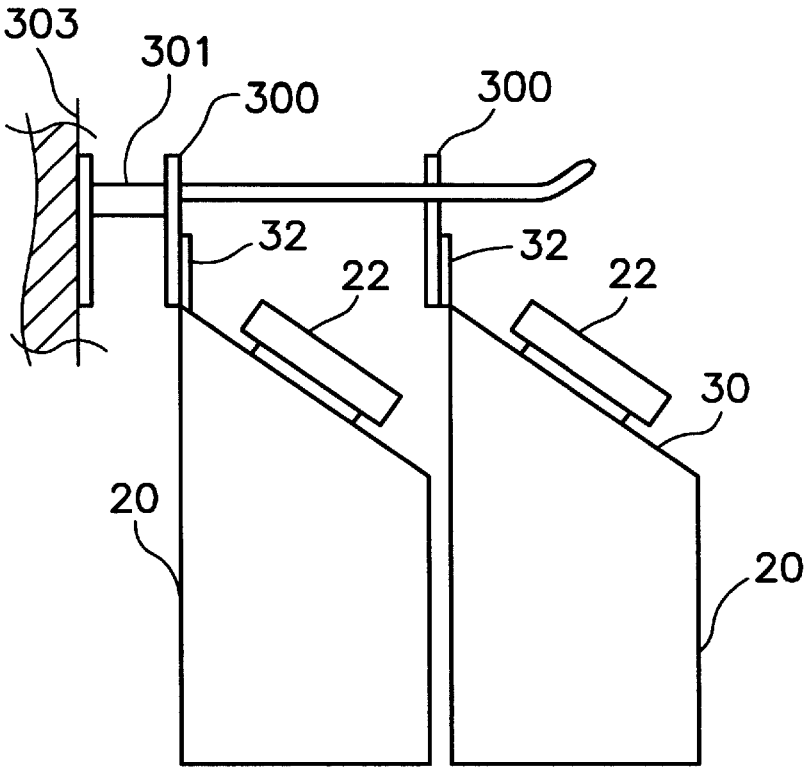
FIG. 9 is a side view of one exemplary marketing display for packages of the present invention.

An exemplary marketing display for the package 20 is illustrated in FIG. 9. The package 20 has a handle 300 attached to the top fin 32 that allows for placement of the package on a rack 301 projecting from a display wall 303. This allows for linear placement of the multiple packages 20 on an elevated display rack.

Figure 10:
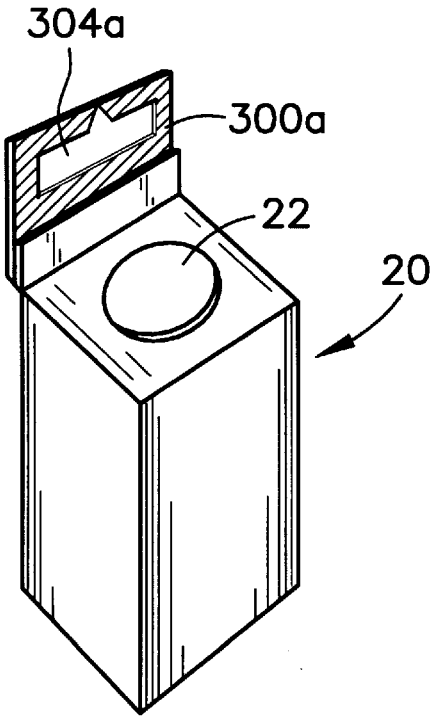
FIG. 10 is a perspective view of the package of FIG. 1 including one embodiment of a handle attached thereto.
Figure 11:
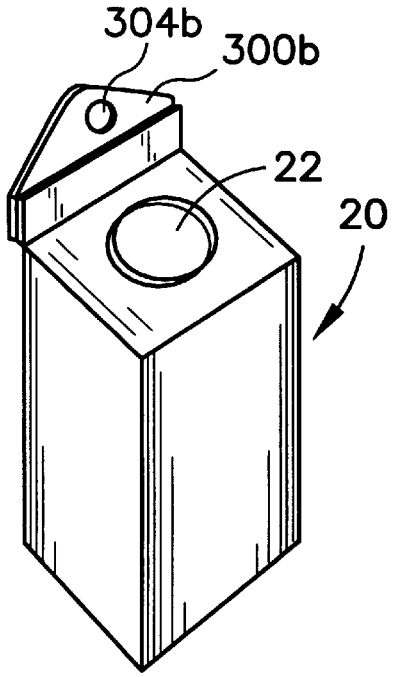
FIG. 11 is a perspective view of the package of FIG. 1 with an alternate embodiment of a handle attached thereto.
Figure 12:
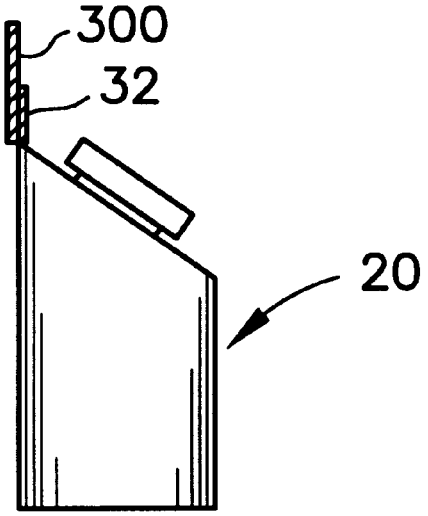
FIG. 12 is a side view of the package of FIG. 1 illustrating one manner of attaching a handle to the package.

Two embodiments of handles 300*a* and 300*b* are illustrated in FIGS. 10 and 11, respectively. The handles 300*a* and 300*b* can be attached to the top fin 32 by hot melt, heat sealed to the thermoplastic surface, and the like. Handle 300*a* has a wide rectangular slot 304*a* while the other handle 300*b* has a smaller circular opening 304*b,* both of which are configured for a display application such as that illustrated in FIG. 9. Referring to FIG. 12 a side view of the package

Figure 13:
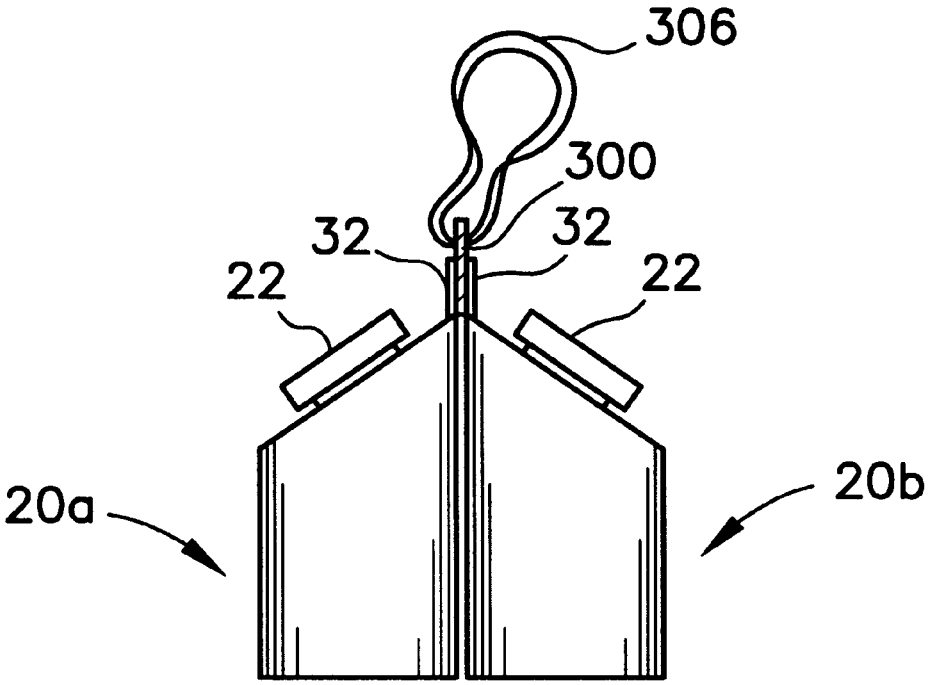
FIG. 13 is a side view of another exemplary marketing display for packages of the present invention.

20 is shown with handle 300 attached thereto by hot melt, heat sealing or the like. FIG. 13 illustrates another exemplary marketing display in which two packages 20*a* and 20*b* are attached to a single handle 300, and in which a loop 306 is positioned through the slot 304 for easy carrying of the packages 20*a* and 20*b*.

Figure 14:
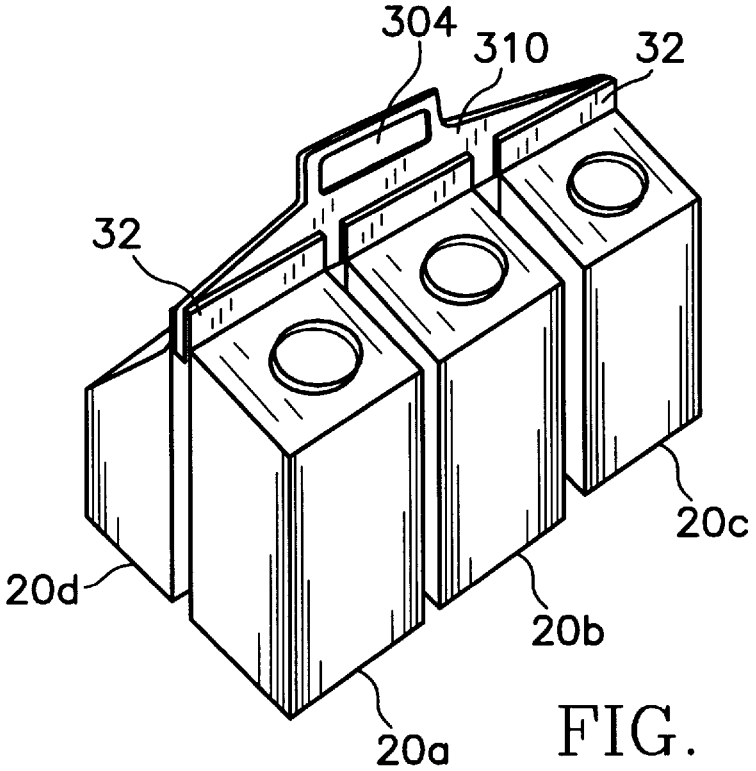
FIG. 14 is a perspective view of an arrangement that includes multiple packages of the present invention connected to one another by a single handle.
Figure 15:
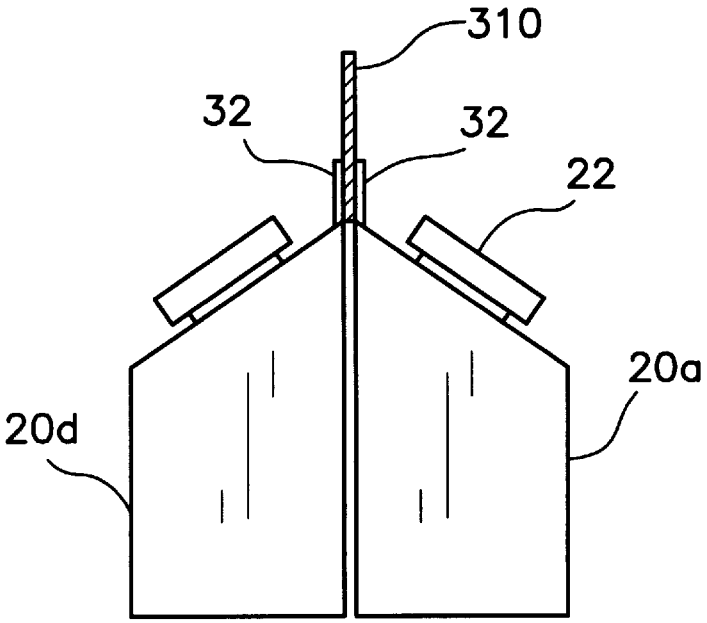
FIG. 15 is a side view of the multiple package arrangement of FIG. 14.

FIGS. 14 and 15 illustrate a multiple package arrangement where six packages 20*a–f* are connected by a single handle 310 having a slot 304. The handle 310 may be attached to all of the packages 20*a–f* by hot melt, heat sealing, or another known attachment method.

Figure 16:
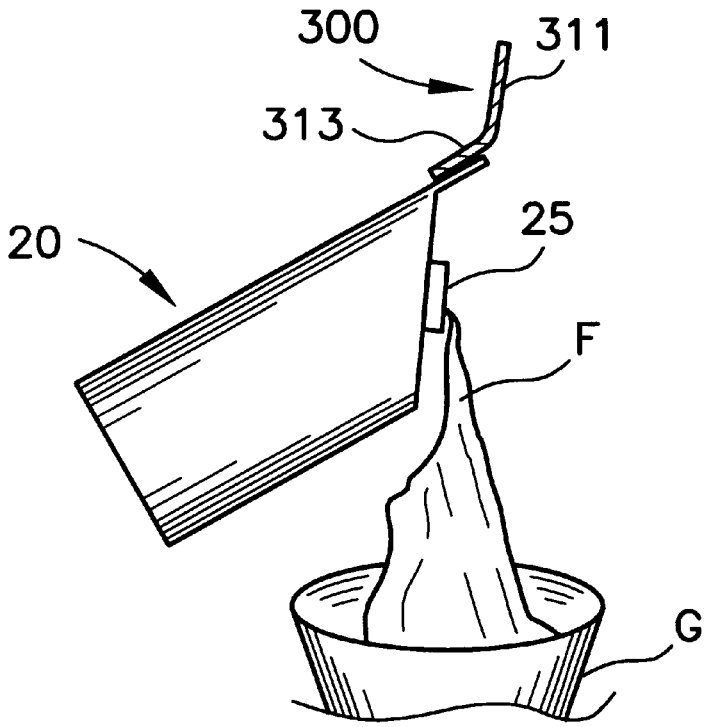
FIG. 16 is a side view of a package of the present invention with a handle attached thereto and with product being poured from the package into a glass.
Figure 17:
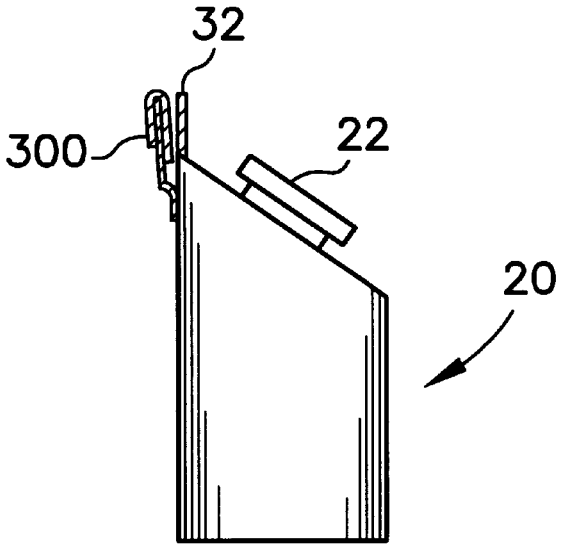
FIG. 17 is a side view of the package of FIG. 16 with the closure cap positioned on the pour spout.

FIG. 16 illustrates a package 20 with a handle 300 having two sections, an unattached section 311 and an attached section 313. The two sections 211 and 213 permit bending the handle 300 to prevent interfering with pouring the product F from the spout 25 into a glass G. As shown in FIG. 17, the unattached section 311 of the handle 300 can be folded onto the attached section 313 in an operative state.

The packages 20, 120 and 220 of the present invention may be of any volume, such as two hundred thirty-six milliliters, five hundred milliliters, one liter, fifteen hundred milliliters, two liters, and the like. The cross-section of the packages 20, 120 and 220 may be square or rectangular. The closures 22 utilized may be of a variety of types, such as threaded, flip-cap, bayonet mount and the like.

While only a limited number of closure types and handle types have been shown and described, and only a few of the many methods for mounting these elements to the containers have been described, it is contemplated that a wide variety of closures and handles can be used, and a wide variety of mounting methods can be employed, which other elements and mounting methods are within the scope of the present invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A package comprising:

an extended top panel;

a front wall engaging the extended top panel at a first edge, the front wall having a predetermined length;

a rear wall, opposite the front wall, the rear wall having a predetermined length; and first and second parallel side walls, each of the side walls engaging the front wall at front edges and the rear wall at rear edges, the top panel being sealed to one of the rear wall and a lesser, opposing top panel at a sealing region, and wherein a vertical plane through the sealing region is spaced from a central vertical plane through the package, wherein the extended top panel extends from the rear wall to the front wall, and wherein the extended top panel is formed at an angle less than ninety degrees to the rear wall.

2. The package in accordance with claim 1 wherein each of the first and second side walls have slanted top edges parallel to each other.

3. The package in accordance with claim 1 including a closure disposed on the top panel.

4. The package in accordance with claim 1 wherein the angle of the extended top panel to the rear wall is between about forty-five degrees and about eighty degrees.

5. The package in accordance with claim 1 including a top fin coextensive with the sealing region and wherein the top fin is disposed at about and adjacent the rear wall.

6. The package in accordance with claim 5 further including a handle attached to the top fin of the package.

7. A multiple of packages, each package formed in accordance with claim 6 wherein the multiple of packages are attached to a single handle.

8. The package in accordance with claim 6 wherein the handle has an unattached section and an attached section, the unattached section foldable over the attached section.

9. A package comprising:

an extended top panel;

a front wall engaging the extended top panel at a first edge, the front wall having a predetermined length;

a rear wall, opposite the front wall, the rear wall having a predetermined length; and first and second parallel side walls, each of the side walls engaging the front wall at front edges and the rear wall at rear edges, the top panel being sealed to one of the rear wall and a lesser, opposing top panel at a sealing region, and wherein a vertical plane through the sealing region is spaced from a central vertical plane through the package, wherein a second top panel meets the extended top panel at a top fin of the package that is coextensive with the sealing region, the second top panel having a surface area lesser than a surface area of the extended top panel.

10. The package in accordance with claim 9 wherein each of the first and second side walls have slanted top edges parallel to each other.

11. The package in accordance with claim 9 including a closure disposed on the top panel.

12. A blank for a package with an extended top panel, the blank comprising:

a rear wall panel, a first side wall panel, a front wall panel and a second side wall panel, the rear wall panel having a length greater than the length of the front wall panel, a plurality of vertical score lines partitioning each of the panels from adjacent of the panels;

an extended top panel adjacent the front wall panel, the extended top panel partitioned from the front wall panel by a first horizontal score line; and a lesser top panel adjacent the rear wall panel the lesser top panel being partitioned therefrom by a horizontal score line, the lesser top panel of the rear wall panel having a surface area less than a surface area of the extended top panel.

13. The blank in accordance with claim 12 further comprising a plurality of triangular top panels.

14. A blank for a package with an extended top panel, the blank comprising:

a rear wall panel, a first side wall panel, a front wall panel and a second side wall panel, the rear wall panel having a length greater than the length of the front wall panel, a plurality of vertical score lines partitioning each of the panels from adjacent of the panels;

an extended top panel adjacent the front wall panel, the extended top panel partitioned from the front wall panel by a first horizontal score line;

a plurality of slanted top panels; and a central top fin panel partitioned from the extended top panel by a top horizontal score line, the central top fin panel juxtaposed by a first and second horizontal top fin panels on each side, the first horizontal top fin panel having a first slanted top fin panel adjacent thereto and the second horizontal top fin panel having a second slanted top fin panel adjacent thereto.

15. A package comprising:

an extended top panel;

a front wall engaging the extended top panel at a first edge, the front wall having a predetermined length;

a lesser top panel;

a rear wall, opposite the front wall, the rear wall engaging the lesser top panel at a second edge, the rear wall having a predetermined length greater than the predetermined length of the front wall; and first and second parallel side walls, each of the side walls engaging the front wall at front edges and the rear wall at rear edges, wherein the extended top panel and the lesser top panel are sealed to one another at a sealing region and wherein the sealing region defines a top fin coextensive with the sealing region.

16. The package in accordance with claim 15 wherein a vertical plane through the fin is spaced from a vertical plane through the package.

17. The package in accordance with claim 15 including a closure disposed on the top panel.

18. The package in accordance with claim 17 wherein the closure includes a spout.

* * * * *